United States Patent [19]

Henriksen

[11] 4,009,506

[45] Mar. 1, 1977

[54] BACKPLATE AND BAIL ASSEMBLY

[75] Inventor: Carl A. Henriksen, Grandville, Mich.

[73] Assignee: Keeler Brass Company, Grand Rapids, Mich.

[22] Filed: Sept. 29, 1975

[21] Appl. No.: 617,425

[52] U.S. Cl. ..... 16/126; 190/58 R

[51] Int. Cl.[2] ..... A47B 95/02

[58] Field of Search ..... 16/126; 190/39, 58 R

[56] References Cited

UNITED STATES PATENTS

| | | | |
|---|---|---|---|
| 93,678 | 8/1869 | Churchill | 16/126 |
| 630,886 | 8/1899 | Held | 16/126 |
| 3,191,215 | 6/1965 | Watt, Jr. | 16/126 |
| 3,248,750 | 5/1966 | Black | 16/126 |
| 3,681,813 | 8/1972 | Ciepley | 16/126 |
| 3,703,683 | 11/1972 | Ciepley | 16/126 |

FOREIGN PATENTS OR APPLICATIONS

| | | | |
|---|---|---|---|
| 205,637 | 10/1923 | United Kingdom | 16/126 |

*Primary Examiner*—Andrew V. Kundrat
*Attorney, Agent, or Firm*—Price, Heneveld, Huizenga & Cooper

[57] ABSTRACT

A backplate and bail assembly is provided including a hollow projection formed on the backplate. The bail includes a generally T-shaped end adapted to be insertable through a slot formed in the backplate projection when the backplate is not secured to a mounting surface. The end is prevented from being withdrawn through the slot when the backplate is secured to the mounting surface.

5 Claims, 3 Drawing Figures

BACKPLATE AND BAIL ASSEMBLY

BACKGROUND OF THE INVENTION

This invention relates generally to drawer pulls and more particularly it concerns a backplate and bail arrangement permitting the bail to be easily assembled to the backplate when the latter is not secured to a mounting surface while preventing removal of the bail from a backplate when the latter is secured to a mounting surface.

Backplate and bail assemblies are known in the prior art of the type including a plate mountable to a surface and to which is pivotably secured a bail or handle. These assemblies are generally employed as drawer pulls. Normally, the bail of handle must be assembled to the backplate during the manufacturing process and therefore the backplate and bail must be shipped as a unit.

Examples of separable backplate and bail assemblies are also known which serve to retain the ends of the bail or handle with the backplate upon assembly and mounting of the backplate to a surface such as a drawer front. These arrangements require apertures or slots to be formed in the backplate at areas in additions to the area of the pivot point structure. Further, due to the nature of their overall shape, some of these prior art arrangements do not adequately distribute the forces encountered during use and therefore are subject to distortion and/or breakage.

SUMMARY OF THE INVENTION

In accordance with the present invention a simple, easily manufactured, backplate and bail assembly is provided for pivotally securing the bail to the backplate only upon mounting of the assembly to a drawer front. Essentially, the backplate includes at least one hollow cylindrical projection closed at the top and having a rectangular slot in the cylinder wall. The bail or handle includes an end shaped so as to be insertable through the slot when the backplate is not attached to the drawer front but which is prevented from being withdrawn from the cylindrical projections when the backplate is secured to the drawer. The end of the bail includes a projections and shank portion having a generally T-shape and extending in a plane perpendicular to the plane of the handle portion of the bail. The shank is angled with respect to the handle to permit the handle to assume a position substantially parallel to the drawer front when in a relaxed position while assuming a position approaching a right angle with respect to the drawer front when in the operating or pull position. In the operating position, the T-shaped end of the bail contacts the interior of the cylindrical projection at two areas to more evenly distribute the pulling force and thereby prevent distortion or breakage of the backplate and bail assembly.

DETAILED DESCRIPTION OF THE PREFERRED EMBODIMENT

Figure 1:
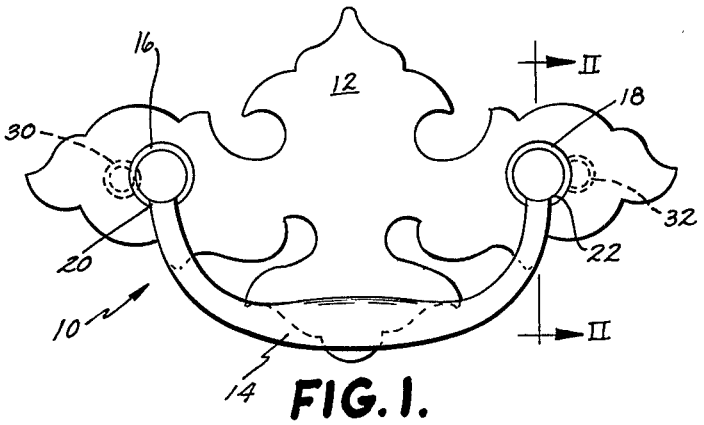
FIG. 1 is a front, elevational view of a backplate and bail assembly in accordance with the present invention.

The preferred embodiment of a backplate and bail assembly in accordance with the present invention is shown in FIG. 1, and generally designated 10. The assembly 10 includes a backplate 12 and a bail or handle 14. The backplate 12 includes a pair of cylindrical projections or pivot points 16 and 18 at which the ends 20 and 22 of the bail 14 are pivotally secured.

Figure 2:
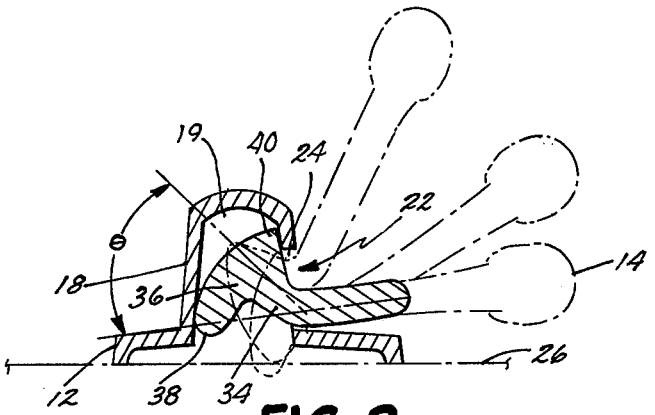
FIG. 2 is a cross section taken along line II—II of FIG. 1.
Figure 3:
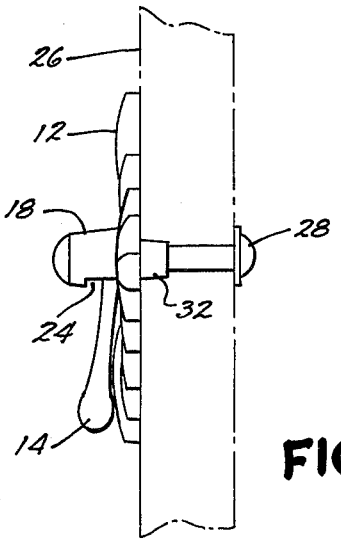
FIG. 3 is a side elevation of a backplate and bail in accordance with the present invention showing the assembly secured to a drawer front.

As best seen in FIGS. 2 and 3, each cylindrical projection 16 and 18 defines a pivot chamber 19 and is provided with a rectangular slot 24 through which the ends 20, 22 extend. The backplate 12 is secured to the face of a mounting surface such as a drawer front 26 by bolts 28. The bolts 28 extend through the drawer front 26 and are threadably secured to internally threaded bosses 30 and 32 formed on a rear face of the backplate 12.

As best seen in FIG. 3, each end 20 and 22 of the handle or bail includes a shank portion 34. The shank portion 34 extends upwardly in a plane perpendicular to the plane of the handle 14 at an angle theta. The shank portion 34 terminates in a projection or foot-like portion 36. The foot-like portion 36 includes a downwardly extending, rounded toe portion 38 and a generally upwardly extending heel portion 40. As can be seen, therefore, each end 20 or 22 of the bail 18 has a generally T-shaped cross section. It is preferred that the angle theta should be approximately 45°.

In FIG. 3, the bail 14 is shown in solid lines in a position assumed when the backplate and bail are assembled and the bail is in a relaxed or at rest position. In assembling the bail 14 to the backplate 12, the ends 20 and 22 are inserted through the slots 24. Due to the shape of the ends and the dimensions of the slots, the toes 38 extend below the rear face of the backplate 12. This is shown in phantom in FIG. 2.

Once the ends 20 and 22 of the handle 14 have been inserted within the cylindrical projections 16, 18 of the backplate 12, the backplate may then be secured to the drawer front 26 (FIG. 2).

In use, the handle 14 is pulled toward the user and pivoted about the cylindrical projections 16 and 18. As shown in phantom in FIG. 3, when the handle 14 assumes the operating position, both the heel 40 and the top portion of each foot 36 abut the inner surface of each cylindrical projection 16 and 18. As a result, the pulling forces are more evenly distributed about the projections 16 and 18 thereby serving to prevent distortion and/or breakage of the backplate. As shown, when the handle 14 is in the operating position, the toe 38 of each end 20 and 22 abut the drawer front 26. This prevents the heel 40 from entering the slot 24 and therefore prevent the ends 20 and 22 of the bail 14 from being withdrawn through the slots 24.

The overall structural arrangement of the handle or bail 14 and the backplate 12 permit each member to be shipped separately and eliminate the necessity for assembly of the backplate and bail at the manufacturing point. Both the backplate and the bail are easily cast items requiring minimal machining and are therefore of relatively low cost. By virtue of the shape of the ends 20 and 22 of the bail 14, the mounting surface of drawer front 26 prevents disassembly once the backplate is secured to the drawer. Further, the shape of the ends 20 and 22 serves to more evenly distribute the pulling forces acting on the backplate. This prevents breakage or distortion of the backplate while still permitting the handle 14 to pivot relative to the backplate 12. As expressly intended, therefore, the foregoing description is illustrative of the preferred embodiment only and is not to be considered limiting. The true spirit and scope of the present invention will be determined by reference to the appended claims.

The embodiments of the invention in which an exclusive property or privilege is claimed are defined as follows.

1. A backplate and bail assembly, comprising:

a backpate;

a bail having an end portion, said end portion including a shank portion and a foot portion integral with and depending transversely from said shank portion said end portion including said foot portion extending in a plane perpendicular to said bail;

means a part of said backplate, for pivotally securing said bail at said bail end portion to said backplate without rotation of said backplate and only when said backplate is secured to a mounting surface, said bail providing a handle portion lying in a single plane and said shank portion being angled upwardly with respect to the plane of said handle portion and said perpendicular plane.

2. A backplate and bail assembly as defined by claim 1 wherein said means a part of said backplate comprises:

a hollow, generally cylindrical projection extending from said backplate and defining a pivot chamber, said projection having formed only in the wall thereof a vertical slot dimensioned so that said end of said bail may be inserted therethrough when said backplate is not secured to a mounting surface while preventing said end from being withdrawn from said pivot chamber through said slot when said backplate is secured to a mounting surface.

3. A backplate and bail assembly, comprising:

a backplate;

a bail having an end portion, said end portion including a shank portion and a foot portion integral with said shank portion said end portion extending in a plane perpendicular to said bail;

means, a part of said backplate, for pivotally securing said bail at said bail end portion to said backplate without rotation of said backplate and only when said backplate is secured to a mounting surface, said means a part of said backplate comprising:

a hollow, generally cylindrical projection extending from said backplate and defining a pivot chamber, said projection having formed only in the wall thereof a vertical slot dimensioned so that said end of said bail may be inserted therethrough when said backplate is not secured to a mounting surface while preventing said end from being withdrawn from said pivot chamber through said slot when said backplate is secured to a mounting surface, and wherein said bail provides a handle portion lying in a single plane and said shank portion is angled upwardly with respect to the plane of said handle portion, and wherein said foot portion of said bail end comprises:

a heel portion and a toe portion shaped so that the inner surface of said projection is contacted by said heel portion and said toe portion when the bail is placed in an operating position and said toe portion abuts a mounting surface thereby preventing said end from being withdrawn from said projection.

4. A backplate and bail assembly as defined by claim 3, wherein said shank portion is angled 45° with respect to said handle portion.

5. A backplate and bail assembly as defined by claim 4, wherein said backplate further includes a second, hollow, generally cylindrical projection having a vertical slot therein and further being longitudinally spaced from said projection, said bail having a generally U-shaped and including a second end portion, and wherein said second end portion includes a shank portion and a foot portion integral with said shank portion and extends in a plane perpendicular to said bail, said shank portion and said foot portion being insertable through said vertical slot of said second projection simultaneously with insertion of said end portion through said vertical slot of said projection.

* * * * *